US006863320B2

(12) United States Patent
Huang

(10) Patent No.: US 6,863,320 B2
(45) Date of Patent: Mar. 8, 2005

(54) DRIVE-IN HOUSING HALVES FOR MOUNTING A LATCH ASSEMBLY IN A DOOR

(75) Inventor: Lan-Shi Huang, Kaohsiung (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 4 days.

(21) Appl. No.: 10/367,837

(22) Filed: Feb. 19, 2003

(65) Prior Publication Data

US 2004/0160070 A1 Aug. 19, 2004

(51) Int. Cl.[7] ..... E05B 9/00
(52) U.S. Cl. ..... 292/337; 292/DIG. 64
(58) Field of Search ..... 292/1.5, 337, DIG. 53, 292/DIG. 64

(56) References Cited

U.S. PATENT DOCUMENTS 4,653,787 A * 3/1987 Fang ..... 292/337
4,662,665 A * 5/1987 Lin ..... 292/167
4,711,477 A * 12/1987 Fann et al. ..... 292/169.14
4,768,817 A * 9/1988 Fann et al. ..... 292/1.5
5,149,151 A * 9/1992 Shen ..... 292/1.5
5,211,432 A * 5/1993 Lin ..... 292/169
5,662,365 A * 9/1997 Ghostley ..... 292/337
6,401,297 B1 * 6/2002 Huang ..... 292/1.5

* cited by examiner

*Primary Examiner*—Gary Estremsky
(74) *Attorney, Agent, or Firm*—Bacon & Thomas

(57) ABSTRACT

A latch assembly includes a casing having at least two engaging slots. A housing consists of two housing halves each having at least two engaging blocks on an inner periphery thereof. The blocks are releasably, securely engaged in the engaging slots of the casing. The latch assembly is mounted in a bore of a door by inserting the housing into the bore with the housing being mounted on the casing of the latch assembly.

8 Claims, 6 Drawing Sheets

DRIVE-IN HOUSING HALVES FOR MOUNTING A LATCH ASSEMBLY IN A DOOR

BACKGROUND OF THE INVENTION

1. Field of the Invention

The present invention relates to drive-in housing halves for mounting a latch assembly in a door.

2. Description of Related Art

U.S. Pat. No. 5,769,472 to Small discloses a drive-in housing consisting of two housing halves for mounting a latch assembly in a door and a method of installing same. As illustrated in FIGS. 1 and 2 of the drawings, the drive-in housing includes two housing halves 10 for simplifying the procedure of mounting a latch assembly 20 in a door. Each housing half 10 has a flange section 101, a mid-section having a plurality of ribs 102 on an outer periphery thereof, and an end section (not labeled). Each housing half 10 further has a slot 103 for receiving and capturing an associated one of two tabs 211 of the latch assembly 20. Further, each housing half 10 has a projection 105 on one of two abutment faces 104 thereof and a groove 106 in the other abutment face 104 thereof, allowing mutual engagement of the housing halves 10. The latch assembly 20 has a cylindrical casing 21, a bolt 22, and a bolt operating mechanism 23. After the drive-in housing halves 10 are assembled on the latch assembly 20, the entire assembly is roughly aligned with the bore of the door and inserted into the door until the ribs 102 come into contact with the wood bounding the periphery of the bore. Next, a driving force is applied to the flange sections 101 of the housing halves 10 in a direction parallel to the axis of the latch assembly 20 until outer faces of the flange sections 101 are flush with an edge surface of the door. The ribs 102 bite into the wood of the door bounding the bore to thus prevent rotation of the housing halves 10 relative to the door.

However, although the ribs 102 allows the latch assembly 20 to be mounted into the bore of the door without using screws, formation of the projection 105 and the groove 106 in the respective abutment faces 104 of each casing half 10 is difficult if the casing half 10 is too thin, and it is impossible to provide tight engagement between the projection 105 and the groove 106; namely, it is not easy to insert the projection 105 into the groove 106 or the projection 105 is apt to break. Further, each housing half 10 and the casing 21 are only engaged through the slot 103 and the tab 211 such that the housing half 10 might fall during installation.

OBJECTS OF THE INVENTION

The object of the present invention is to provide a drive-in housing consisting of two housing halves for mounting a latch assembly in a door. The housing halves allow easy manufacture and easy assembly, and the engagement between the housing halves and the casing is enhanced.

SUMMARY OF THE INVENTION

To achieve the aforementioned object, the present invention provides a combination of a latch assembly and a drive-in housing. The latch assembly includes a casing having at least two engaging slots. The housing consists of two housing halves each having at least two engaging blocks on an inner periphery thereof. The blocks are releasably, securely engaged in the engaging slots of the casing. The latch assembly is mounted in a bore of a door by means of inserting the housing into the bore with the housing being mounted on the casing of the latch assembly.

Each housing half has a plurality of axially extending ribs on an outer periphery thereof. Each housing half further has two slots, and the casing having two tabs received in the slots. Each housing half has two abutment faces, and each sot is defined in an associated abutment face. Each engaging block has an inclined face adjacent to an associated abutment face. Each engaging block further has a perpendicular face that is spaced from an associated abutment face and that extends in a direction parallel to an associated abutment face. Further, each casing half further has a notch defined in an associated abutment face. One of the engaging blocks is located adjacent to the notch.

Other objects, advantages and novel features of this invention will become more apparent from the following detailed description when taken in conjunction with the accompanying drawings.

DETAILED DESCRIPTION OF THE PREFERRED EMBODIMENT

Figure 1:
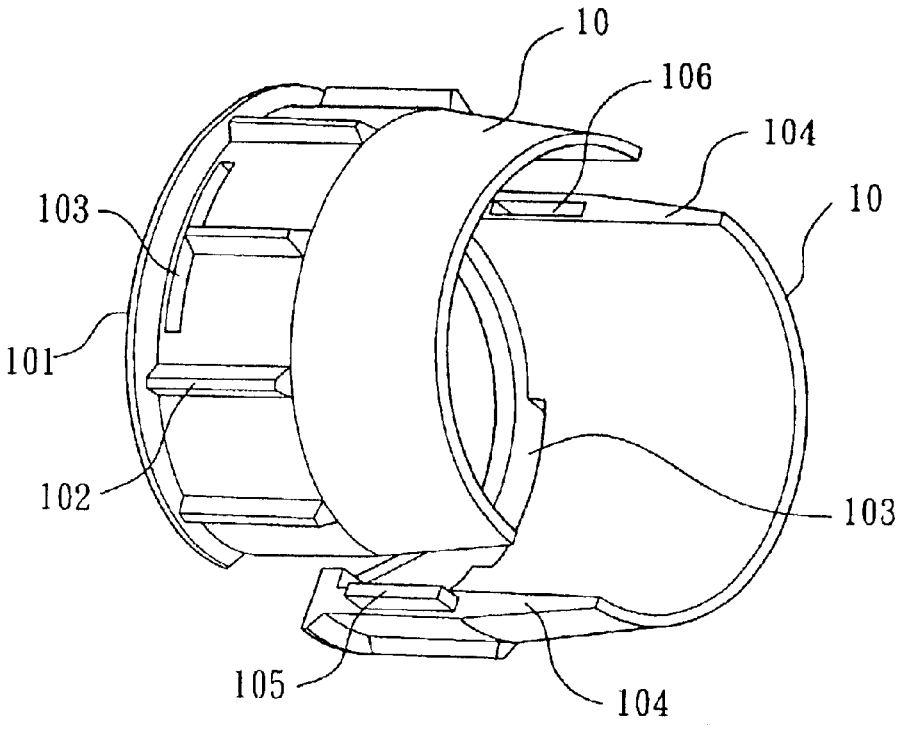
FIG. 1 PRIOR ART
FIG. 1 is an exploded perspective view of a conventional drive-in housing consisting of two housing halves.
Figure 2:
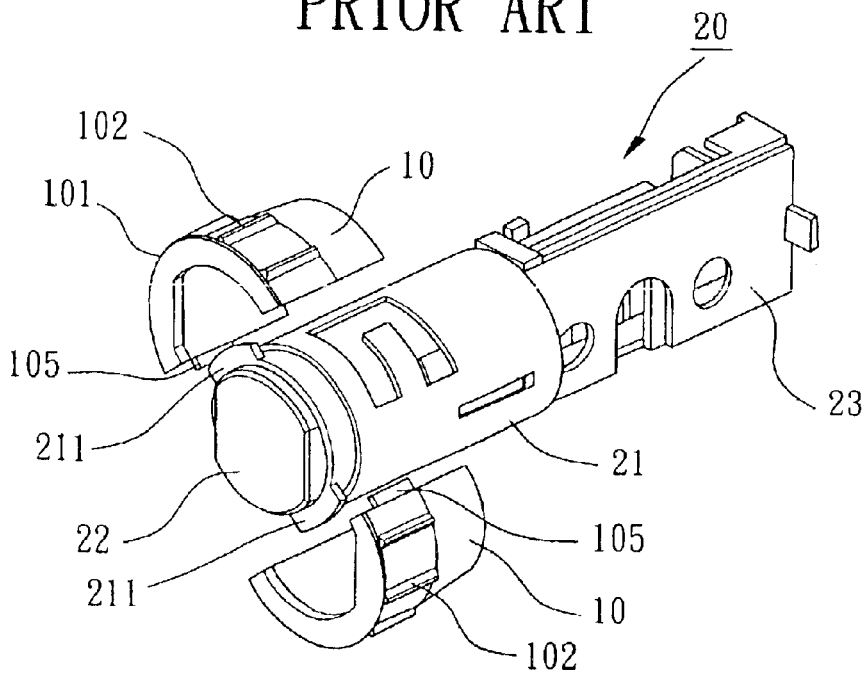
FIG. 2 PRIOR ART
FIG. 2 is a perspective view, partly exploded, of the conventional drive-in housing and a latch assembly to which the conventional drive-in housing is mounted.

The present invention is now to be described hereinafter in detail, in which the same reference numerals are used for the same parts as those in the prior art.

Figure 3:
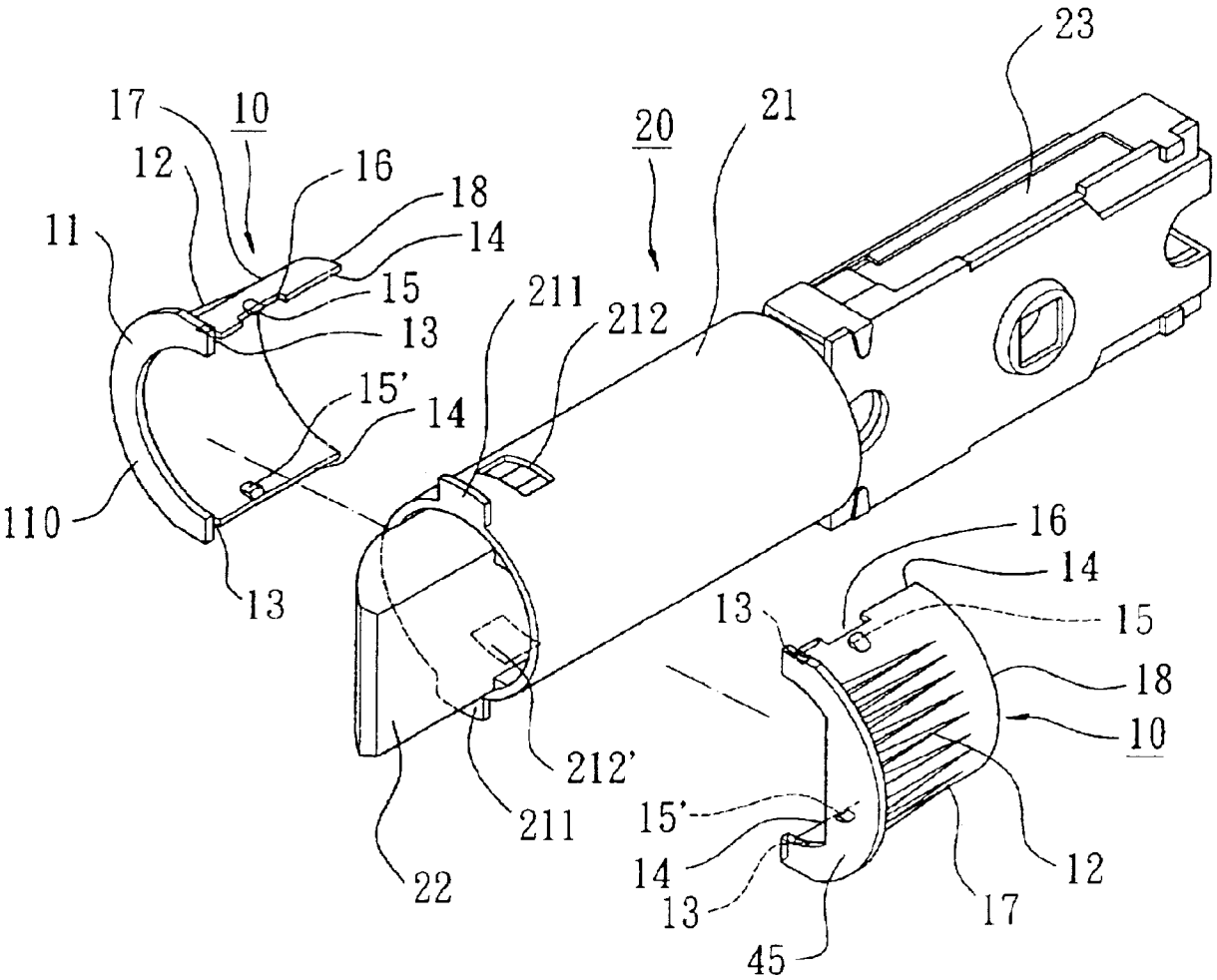
FIG. 3 is a perspective view, partly exploded, of a latch assembly and a drive-in housing in accordance with the present invention.
Figure 4:
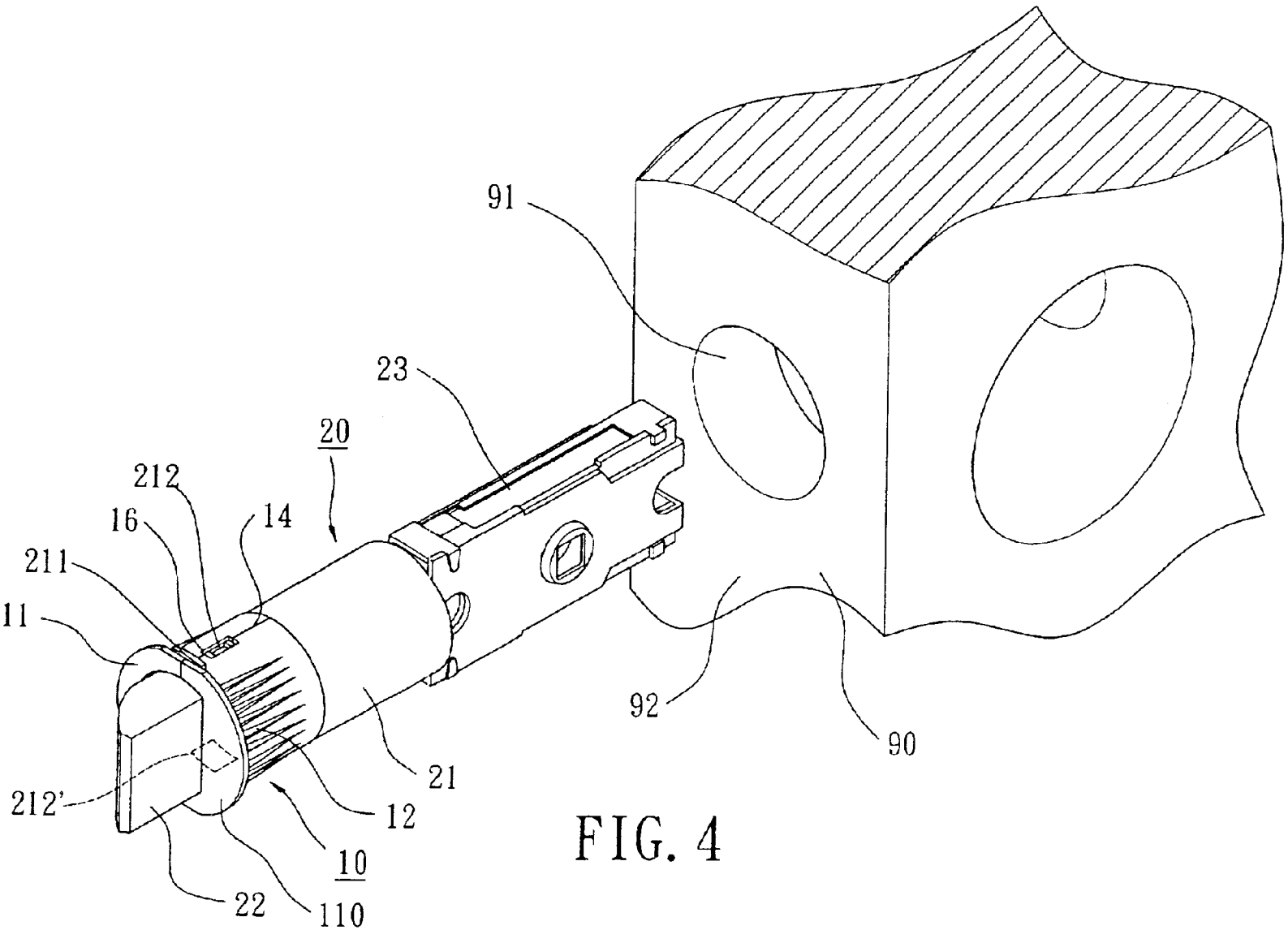
FIG. 4 is a perspective view illustrating installation of the latch assembly in a bore of a door.
Figure 5:
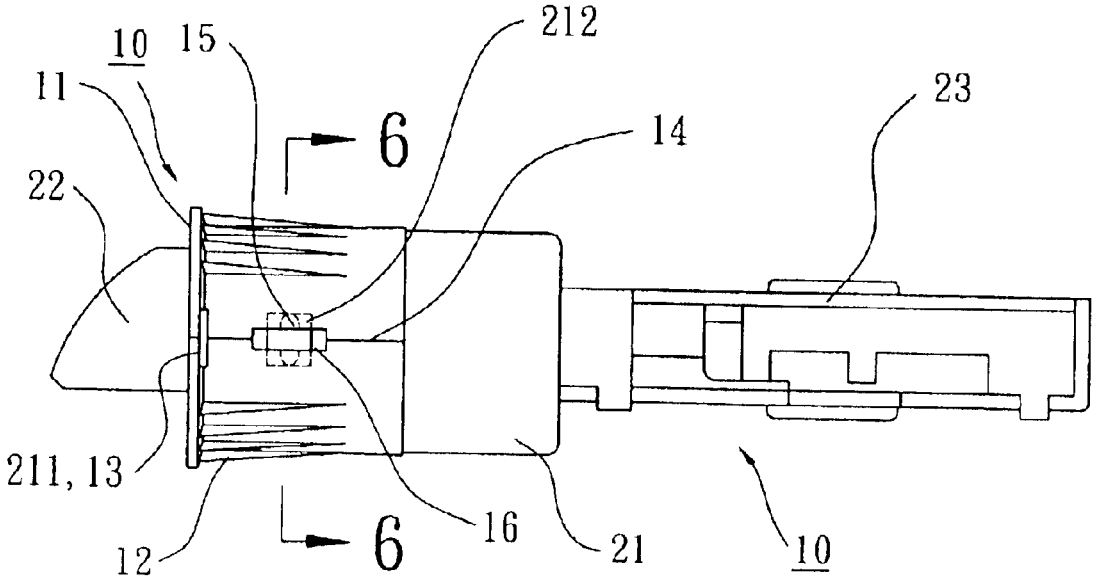
FIG. 5 is a side view of the latch assembly with the drive-in housing mounted thereto.

Referring to FIGS. 3 through 5, the present invention includes a latch assembly 20 and a drive-in housing consisting of two housing halves 10 for mounting the latch assembly 20 in a door. The latch assembly 20 has a cylindrical casing 21, a bolt 22, and a bolt operating mechanism 23 for controlling extension and retraction of the bolt 22. The cylindrical casing 21 includes two tabs 211 formed thereon. Each housing half 10 is substantially semi-cylindrical and made of metal or rigid plastic material. Each housing half 10 has a flange section 11, a mid-section 17 having a plurality of axially extending ribs 12 on an outer periphery thereof, and an end section 18. Further, each housing half 10 has two abutment faces 14.

Each housing half 10 further has at least two engaging blocks 15 and 15' on an inner periphery thereof, and the casing 21 has at least two engaging slots 212 and 212' for securely receiving the engaging blocks 15 and 15' of the casing 21. The flange sections 11 serve as a face plate. Further, the flange sections 11 provide ornamentation and prevent the housing halves 10 from being stuck in a bore 91 of a door 90 (FIG. 4). Each housing half 10 further has a slot 13 in an end of each abutment face 14 and adjacent to the flange section 11. Each housing half 10 further has a notch 16 in a mid-portion of one of the abutment faces 14. One of the engaging blocks, e.g., the engaging block 15 is preferably located adjacent to the notch 16. This allows a user to remove the housing halves 10 from the latch assembly 20. In an alternative design, the slot 13 may be defined in the housing half 10 at a position spaced apart from the abutment face 14, such as the slot 103 in FIG. 1.

The tabs 211 of the casing 21 are engaged in the slots 13 of the housing halves 10. The engaging blocks 15 and 15' of the housing halves 10 are respectively engaged in the engaging slots 212 and 212' of the casing 21. Thus, the engagement between the housing halves 10 and the latch assembly 20 are firmer than the conventional design. Further, the housing halves 10 and the casing 21 are easy to manufacture to form the slots 13, the engaging blocks 15 and 15', the tabs 211, and the engaging slots 212 and 212'.

Figure 6:
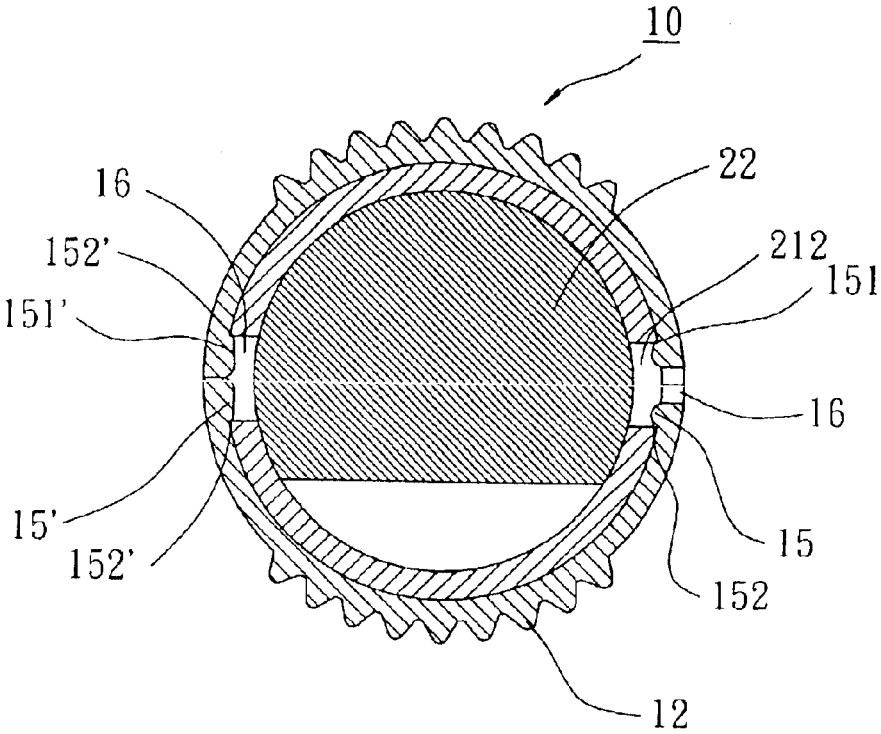
FIG. 6 is a sectional view taken along plane 6—6 in FIG. 5.
Figure 7:
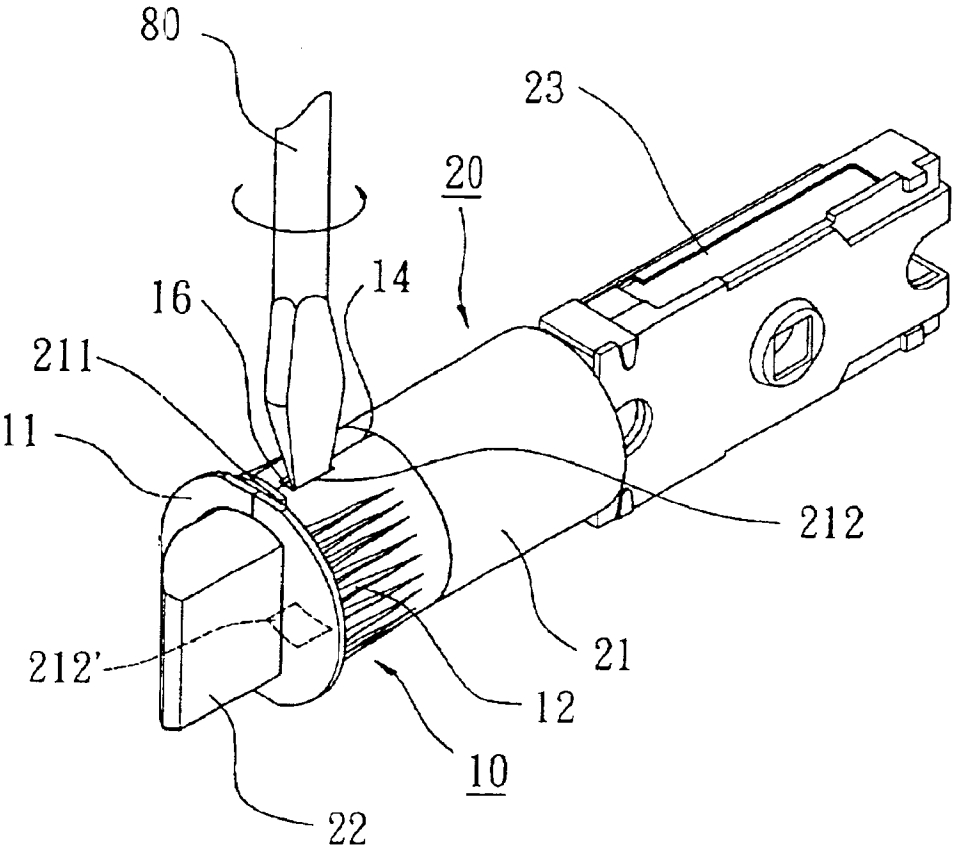
FIG. 7 is a perspective view illustrating detachment operation of the drive-in housing.

Referring to FIG. 6, the housing halves 10 made of metal possess a certain extendibility to allow the engaging blocks 15 and 15' to smoothly slide into the engaging slots 212 and 212'. Further, each engaging block 15, 15' has an inclined face 151, 151' adjacent to the associated abutment face 14 and a perpendicular face 152, 152' that is spaced apart away from the associated abutment face 14 and that extends in a direction parallel to the associated abutment face 14. This further allows the engaging blocks 15 and 151' to smoothly slide into the engaging slots 212 and 212' while providing a firmer engagement. Referring to FIG. 7, the user may use a tool 80 (e.g., a screwdriver) to detach the housing halves 10 from the casing 21. The tool 80 is extended into the engaging slot 16 and then rotated. Thus, the latch assembly 20 can be used with other elements when required.

After the drive-in housing halves 10 are assembled on the latch assembly 20, the entire assembly is roughly aligned with the bore 91 of the door 90 and inserted into the door 90 until the ribs 12 come into contact with the wood bounding the periphery of the bore 91. Next, a driving force is applied to the flange sections 11 of the housing halves in a direction parallel to the axis of the latch assembly 20 until outer faces 110 of the flange sections 10 are flush with an edge surface 92 of the door 90. The ribs 12 bite into the wood of the door 90 bounding the bore 91 to thus prevent rotation of the housing halves 10 relative to the door 90.

Figure 8:
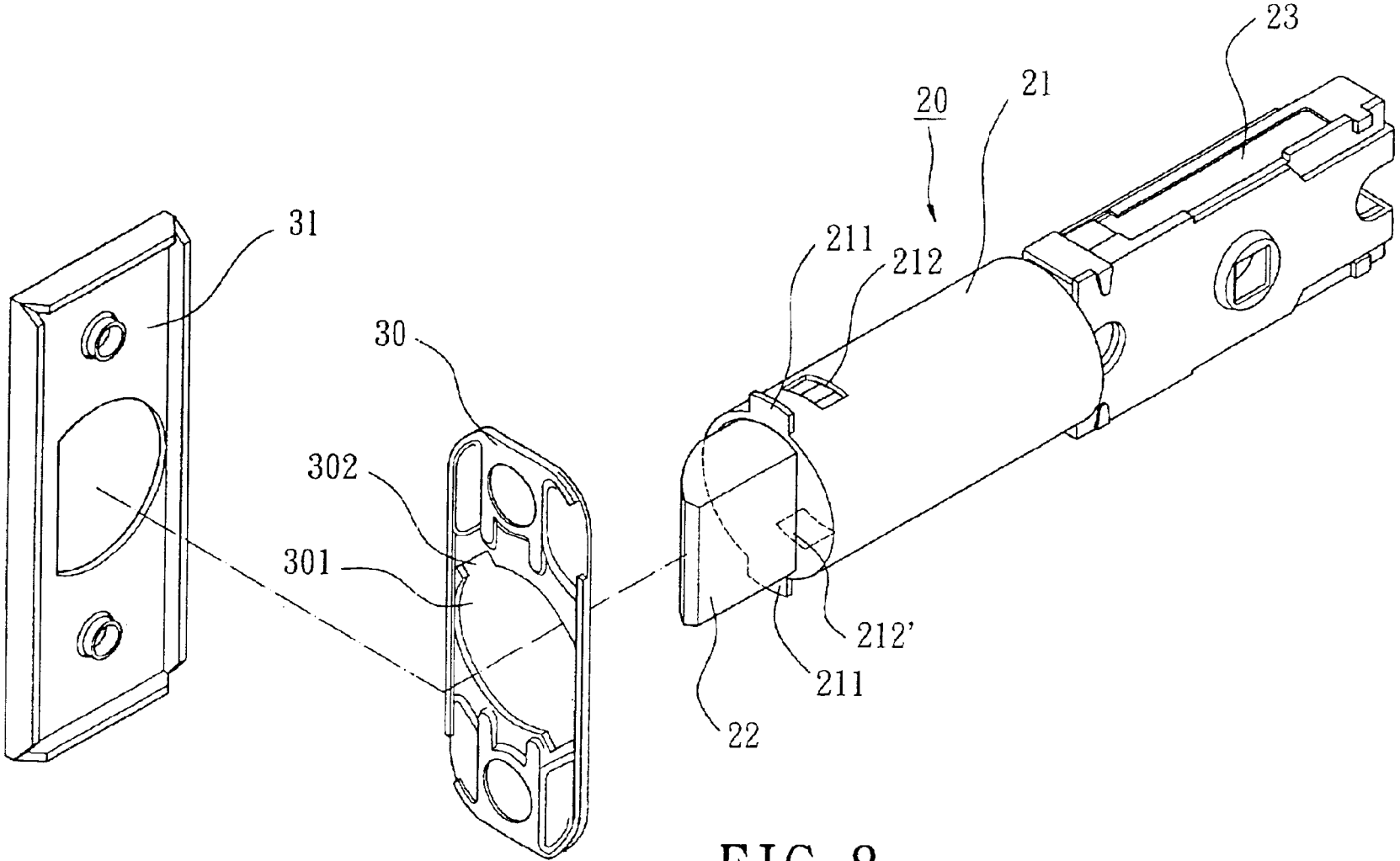
FIG. 8 is an exploded perspective view illustrating a modified embodiment of the present invention.

Referring to FIG. 8, the latch assembly 20 can be used with a fixing plate 30 and a decorative plate 31. The fixing plate 30 has a central hole 301 with two notches 302 in a periphery defining the central hole 301. The notches 302 are offset from a vertical axis of the fixing plate 30. The latch assembly 20 is extended through the central hole 301 of the fixing plate 30 with the tabs 211 passing through the notches 302 of the fixing plate 30. Next, the latch assembly 20 is turned back to an upright position with the tabs 211 not aligned with the notches 302. Thus, the latch assembly 20 can be mounted by screws to doors having various bore sizes in the bore 91 through the use of the fixing plate 30 and the decorative plate 31.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A combination of a latch assembly and a drive-in housing, comprising:

a latch assembly including a casing having at least two engaging slots; and a housing comprising two separate housing halves each having at least two engaging blocks on an inner periphery thereof, said at least two engaging blocks of each of said separate housing halves being releasably and securely engaged in said at least two engaging slots of the casing so that said separate housing halves cover the casing to constitute the combination of the latch assembly and the housing, the latch assembly configured to be mounted in a bore of a door by insertion of the combination of the latch assembly and the housing therein.

2. The combination as claimed in claim 1, wherein each of said housing halves has a plurality of axially extending ribs on an outer periphery thereof.

3. The combination as claimed in claim 1, wherein each of said housing halves further has two slots, said casing having two tabs received in the slots.

4. The combination as claimed in claim 3, wherein each of said housing halves has two abutment faces, and wherein each said slot is defined in an associated one of the abutment faces.

5. The combination as claimed in claim 1, wherein each of said housing halves has two abutment faces, and wherein each said engaging block has an inclined face adjacent to an associated one of the abutment faces.

6. The combination as claimed in claim 1, wherein each of said housing halves has two abutment faces, and wherein each said engaging block has a perpendicular face that is spaced from an associated one of the abutment faces and that extends in a direction parallel to an associated one of the abutment faces.

7. The combination as claimed in claim 1, wherein each of said housing halves has two abutment faces, and wherein each of said housing halves further has a notch defined in one of the abutment faces.

8. The combination as claimed in claim 7, wherein one of the engaging blocks is located adjacent to said notch.

* * * * *